US005584384A

United States Patent [19]

Mizuno et al.

[11] Patent Number: 5,584,384

[45] Date of Patent: Dec. 17, 1996

[54] PUSH BUTTON SWITCH

[75] Inventors: Yoshiyuki Mizuno; Kikuo Ogawa, both of Shizuoka, Japan

[73] Assignee: Yazaki Corporation, Tokyo, Japan

[21] Appl. No.: 376,887

[22] Filed: Jan. 20, 1995

[30] Foreign Application Priority Data

Jan. 21, 1994 [JP] Japan ..... 6-005252

[51] Int. Cl.[6] ..... H01H 3/42

[52] U.S. Cl. ..... 200/524; 200/523

[58] Field of Search ..... 200/524, 520, 200/517, 523, 341, 342, 344, 345, 521

[56] References Cited

U.S. PATENT DOCUMENTS 4,156,802 5/1979 Gilano et al. ..... 200/517

4,417,115 11/1983 Desmarais et al. ..... 200/524

4,559,426 12/1985 Van Zeeland et al. ..... 200/524

*Primary Examiner*—David J. Walczak

*Attorney, Agent, or Firm*—Sughrue, Mion, Zinn, Macpeak & Seas

[57] ABSTRACT

A push button switch including a moving member movably disposed inside a housing, a movable contact provided on the moving member, a fixed contact disposed inside the housing, a main spring for urging the moving member toward the fixed contact, and a push button disposed in an opening in the housing so as to engage the moving member. When the push button is pushed toward the fixed contact, the moving member is moved by the main spring by a preset distance toward the fixed contact so that the movable contact contacts the fixed contact. An auxiliary spring urges the push button in a direction away from the fixed contact by a force that is larger than a force of the main spring. The auxiliary spring has a larger diameter than the main spring, is substantially coaxial with the main spring, and can overlap the main spring.

4 Claims, 4 Drawing Sheets

PUSH BUTTON SWITCH

BACKGROUND OF THE INVENTION

1. Field of the Invention

The present invention relates to a push button switch of the type in which it is turned on (or off) when a push button is pushed, and is turned off (or on) when the push button is pushed once more.

2. Related art

A push button switch constructed as shown in FIGS. 6 and 7 has been known for this type of the push button switch. In the construction of this conventional switch, a movable contact 2 is operated by a push button 1. The push button 1 includes a first inner surface 1*a* fit into a space defined by a guide wall 3*a* of a housing 3. A first spring 4 urging the push button 1 upward is within a space defined by the first inner surface 1*a*. A second inner surface 1*b* is further included by the push button 1. It Is located on the outer side of the first inner surface 1*a*. A sleeve (moving member) 5 is fit into a space defined by the second inner surface 1*b* of the push button 1. The movable contact 2 is mounted on the bottom surface of the sleeve 5. A fixed contact 6, located in opposition to the movable contact 2, is mounted on the inner side of the bottom of the housing 3.

A second spring 7 for urging the sleeve 5 downward is provided within a space defined by the second inner surface 1*b*. The second spring 7 is in a fully expanded state when the push button 1 is not depressed, i.e., the switch is in an off state. A force of the spring to urge the movable contact 2 toward the fixed contact 6 is zero. Under the sleeve 5, a cylindrical rubber contact 8 surrounds the movable contact 2. The rubber contact 8 functions such that when the urging force of the second spring 7 is substantially zero, it separates the movable contact 2 apart from the fixed contact 6 by its elastic force. A heart cam, not shown, is further included in the push button 1. A pin 9 operating along the outer surface of the heart cam is contained in the housing 3.

The heart cam is a plate-like cam of which the upper side includes and incurred part. When the push button 1 is depressed, the pin 9 moves upward along the outer circumference of the heart cam and is put in the incurved part of the heart cam, so that the push button 1 is held at a predetermined depth level. When the push button 1 is depressed again, the pin 9 disengages from the incurved part, thereby placing the push button 1 in a free state.

In the push button switch thus constructed, in a state that the push button switch is in an off state, when the push button 1 is depressed, the first and second springs 4 and 7 are compressed. At this time, the compressing force of the second spring 7 is larger than the holding force of the rubber contact 8, bringing the movable contact 2 into contact with the sleeve 5. Under this condition, the pin 9 is put at the incurred part of the heart cam, and the push button 1 is left depressed, i.e., an on state of the push button switch is maintained.

When the push button 1 is depressed once more, the first and second springs 4 and 7 are further compressed slightly, so that the pin 9 disengages from the incurred part of the heart cam. Then, the repulsive forces of the first and second springs 4 and 7 push the push button 1 upward. As a result, the second spring 7 is fully expanded, and the elastic force of the rubber contact 8 separates the movable contact 2 from the fixed contact 6, i.e., the push button switch is in an off state.

In the conventional push button switch thus constructed and operated, the push button i is movably assembled into the housing 3. The sleeve 5 is movably coupled with the push button 1. Accordingly, it can be considered that the sleeve 5 moves under a large tolerance A+B (A: fitting tolerance between the first inner surface 1*a* and the guide wall 3*a*, and B:fitting tolerance between the second inner surface 1*b* and the sleeve 5). In other words, when the push button 1 is depressed, the sleeve 5 moves in a greatly inclined state. The movable contact 2 comes in contact with the fixed contact 6 also in a greatly inclined state. Consequently, a poor contact problem tends to occur in the conventional push button switch.

SUMMARY OF THE INVENTION

Accordingly, an object of the present invention is to provide a push button switch which can reduce a frequency of the occurrence of the poor contact trouble, and the height of the push button switch product.

To achieve the above object, there is provided a push button switch comprising a moving member movably assembled into a housing; a movable contact provided at a first end face of the moving member; a fixed contact provided on the housing; a make-contact coiled spring for urging the moving member toward the fixed contact; a push button disposed, within the housing, on a second end face of the moving member so as to be movable in the same direction as of the moving member, when the push button is pushed toward the fixed contact, the moving member is allowed to move a preset distance toward the fixed contact and the moving member is allowed to come in contact with the fixed contact; a cam, formed in the push button, for setting up on and off states of the switch; a break-contact coiled spring for urging the push button toward a direction which is detached from the fixed contact by a force being larger than a force of the make-contact spring, the break-contact spring being mounted in the push button in such a manner that the break-contact spring is substantially coaxially arranged with the make-contact spring; a pin operating such that when the push button is pushed toward the fixed contact, the pin engages the cam, thereby placing the push button in a state that the push button is pushed to a predetermined depth, and when the push button is further pushed, the pin disengages from the cam, thereby returning the push button to its original position; and the inner diameter of the break-contact coiled spring being larger than that of the make-contact coiled spring, whereby these coiled springs are combined in an overlapping fashion.

With such a construction of the push button switch, when the push button is depressed in an off state of the switch, the push button moves toward the fixed contact while resisting the force of the make-contact coiled spring. Then, the moving member is movable toward the fixed contact. Accordingly, the movable contact is allowed to come in contact with the fixed contact. The make-contact coiled spring urges the moving member to move toward the fixed contact, so that these contacts are brought into contact with each other. An on state of the push button switch is set up. At the same time, the pin engages the cam, thereby placing the push button in a state that it is pushed to a predetermined depth. Accordingly, the movable contact is left in contact with the fixed contact. In other words, an on state of the switch continues.

When the push button is pushed again, the break-contact coiled spring is slightly compressed, while at the same time the pin disengages from the cam. The push button is placed in a free state, and the break-contact coiled spring urges the push button to return to its original position. At this time, the moving member, together with the push button, moves apart from the fixed contact since the force of the break-contact coiled spring is larger than that of the make-contact coiled spring. An off state of the switch is set up.

Since the moving member is movably assembled into the housing, there is eliminated the sum of the two fitting tolerances, and hence a great inclination of the moving member when it moves. Accordingly, the movable contact is brought into contact with the fixed contact 12 in a state that these contacts are substantially parallel to each other. The poor contact trouble rarely occurs.

Additionally, the inner diameter of the break-contact coiled spring is larger than that of the make-contact coiled spring. These coiled springs are combined in an overlapping fashion. With this structure, the height of the push button switch may be reduced by a height corresponding to the length of the overlapping portion.

DETAILED DESCRIPTION OF THE PREFERRED EMBODIMENTS

The preferred embodiment of the present invention will be described with reference to FIGS. 1 through 5 and 8.

Figure 8:
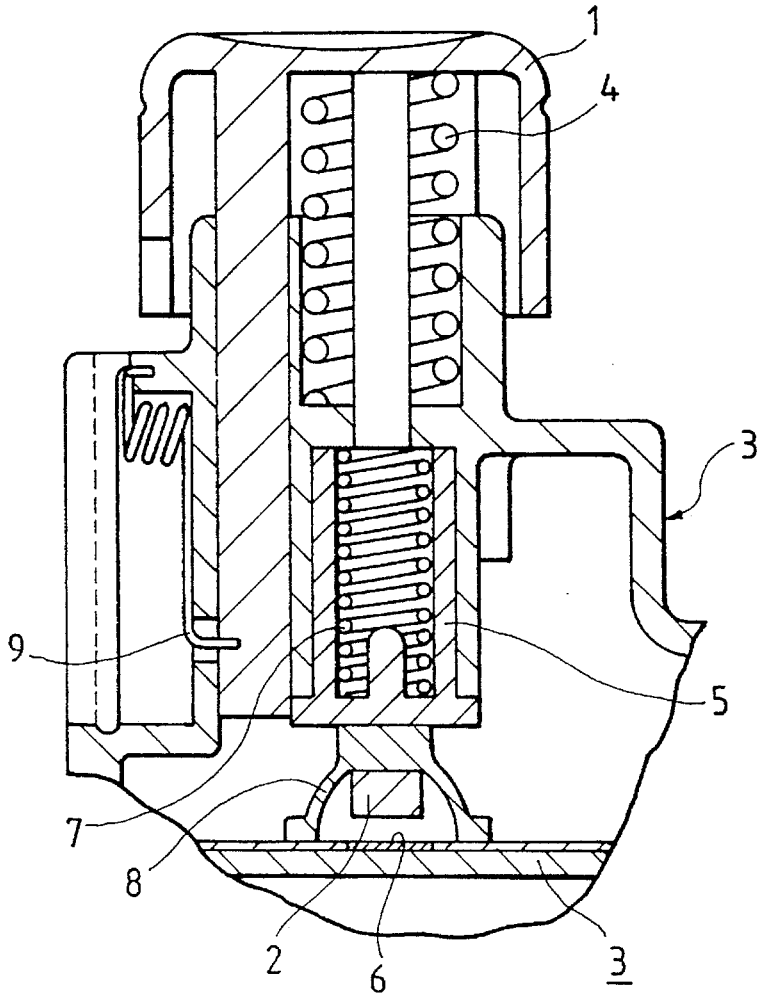
FIG. 8 is a cross sectional view showing a push button swatch of a first embodiment of the present invention.

The push button switch of the first embodiment of the present invention as shown in FIG. 8. In this push button switch, the sleeve 5 is movably provided in the housing 3. Therefore, the inclination of the sleeve 5 is reduced, so that the poor contact problem of the conventional switch is prevented from occurring.

In the construction of the improved conventional push button switch, the first (auxiliary) spring 4 is located above the second (main) spring 7. This results in increase of the height of the switch.

FIGS. 1 through 5 show a second embodiment of the present invention.

Figure 2:
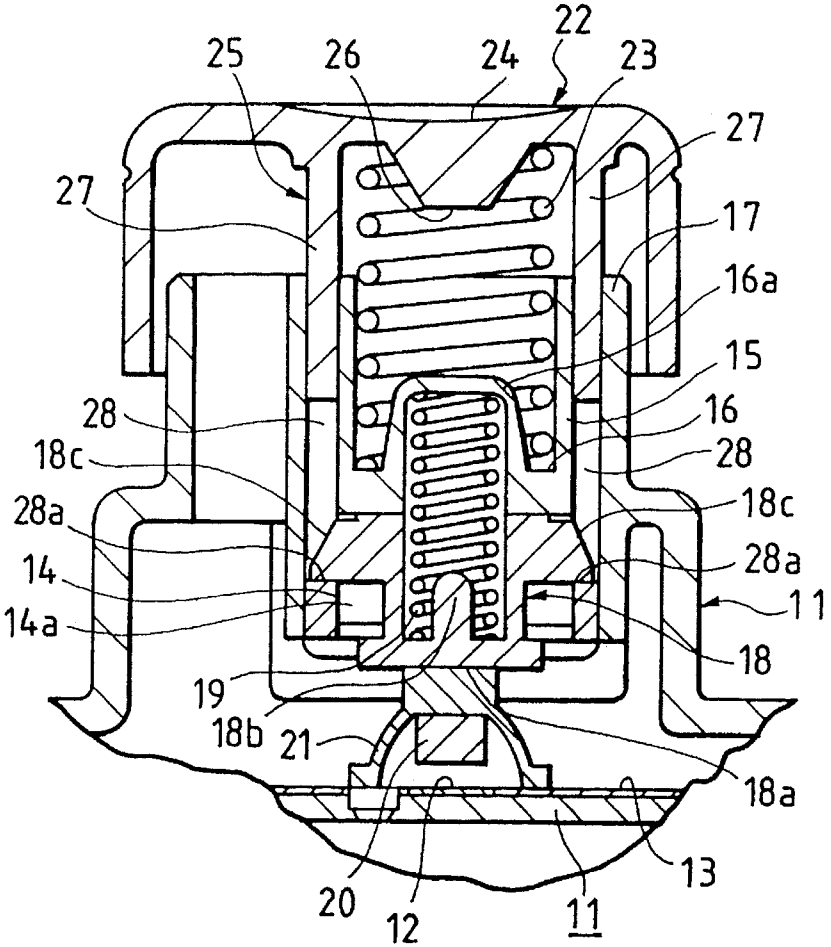
FIG. 2 is a cross sectional view showing the push button switch of FIG. 1 when viewed in the direction displaced 90° from the view of FIG. 1.
Figure 1:
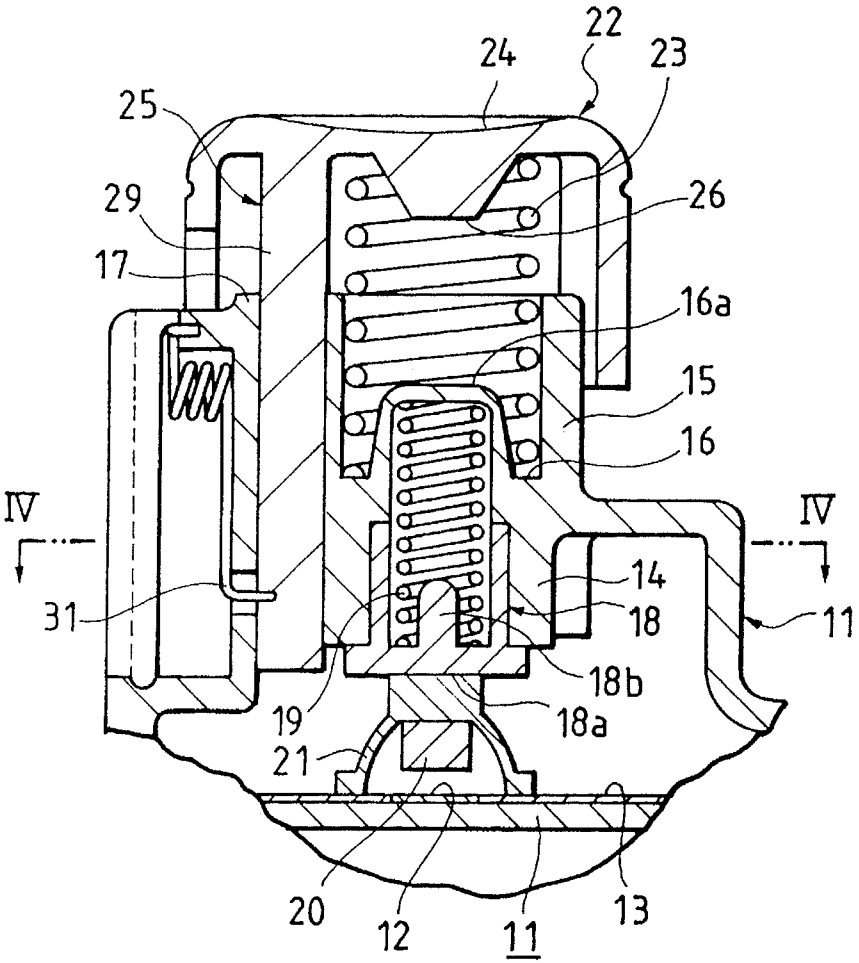
FIG. 1 is a cross sectional view showing a push button switch according to a second embodiment of the present invention.

In FIGS. 1 and 2, reference numeral 11 designates a housing forming a main body of a push button switch. A wiring board 13 with a fixed contact 12 is placed in the housing 11. The housing 11 includes a lower guide tube 14 shaped square in cross section and an upper guide tube 15 also square in cross section. These tubes 14, 15 are disposed above the fixed contact 12 and they extend in opposite directions. The lower and upper guide tubes 14 and 15 are partitioned by a partition plate 16. A central part of the partition plate 16 is upward curved to form a conical part 16*a*. An outer guide tube 17 (FIG. 4) surrounds the lower and upper guide tubes 14 and 15.

Figure 4:
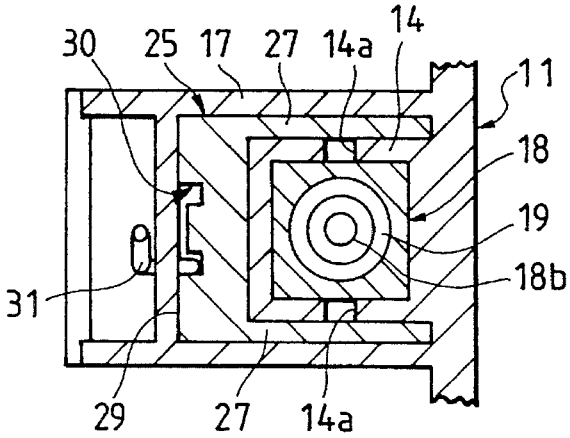
FIG. 4 is a cross sectional view taken on line IV—IV in FIG. 1.
Figure 6:
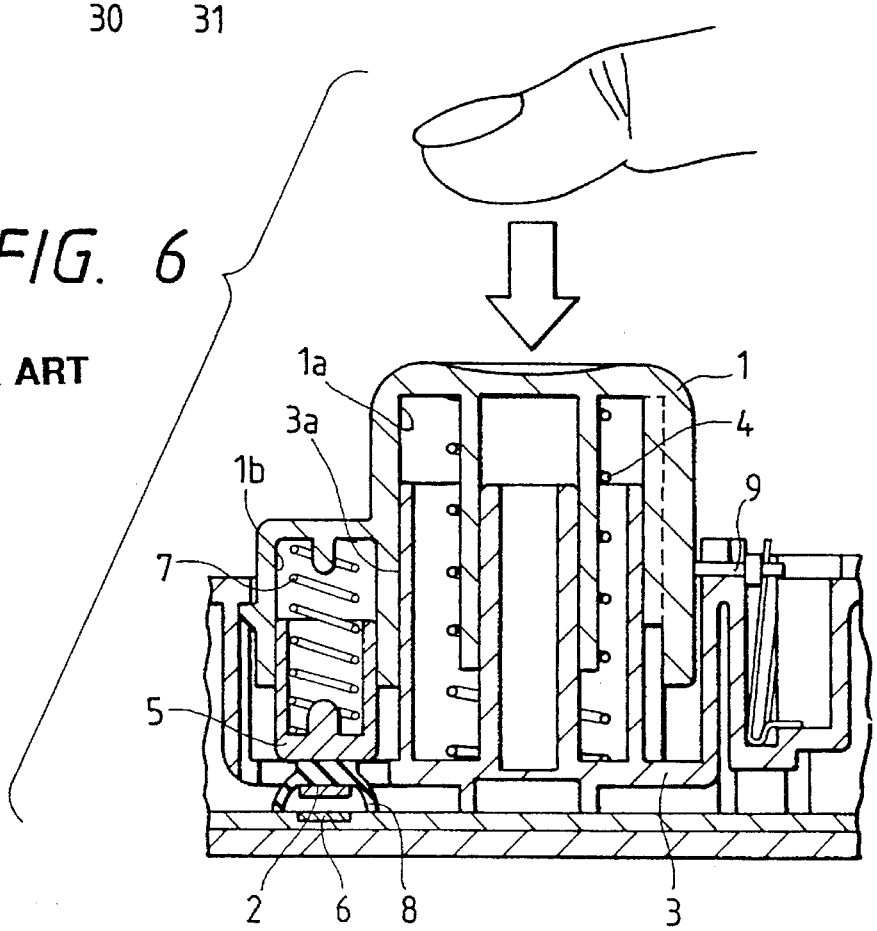
FIG. 6 PRIOR ART
FIG. 6 is a cross sectional view showing a conventional push button switch.

The lower guide tube 14 guides a sleeve (moving member) 18 to and from the fixed contact 12. Cutouts 14*a* and 14*a* are formed in the opposed locations of the side wall of the lower guide tube 14 as shown in FIG. 4. The outer configuration of the sleeve 18 is square in cross section so as to exactly be fit into the lower guide tube 14, while the inner configuration thereof is circular in cross section. The bottom of the sleeve 18, which faces the fixed contact 12, is closed by a bottom wall 18*a*. A cylindrical pole 18*b* stands upright from the axial position on the bottom wall 18*a*. Protruded portions 18*c* and 18*c* are extended outward from the locations of the upper end of the sleeve 18, which correspond to the cutouts 14*a* and 14*a* of the lower guide tube 14. The protruded portions 18*c* and 18*c* are respectively inserted into the cutouts 14*a* and 14*a*, and they protrude outside the cutouts 14*a* and 14*a*.

The lower sides of the tips of the protruded portions 18*c* and 18*c* are put on the lower parts 28*a* of stopper holes 28 of a push button 22 to be described later. A coiled (main) spring 19 for making contact is provided within the sleeve 18. A movable contact 20 is placed at a location of the lower side of the bottom wall 18*a*, which corresponds to the location of the fixed contact 12. The make-contact coiled spring 19 is so arranged that one end thereof is in contact with the bottom wall 18*a*, while the other end thereof is placed within the conical part 16*a* in a state that it is in contact with the ceiling of the conical part 16*a*. The coiled spring 19 so arranged is compressed in a preset degree of compression.

A fan-shaped rubber contact 21 covers the movable contact 20. The rubber contact 21 is made of elastic material soft enough to allow such an operation that when it receives an urging force of the coiled spring 19, it is deflected to allow the movable contact 20 to come in contact with the fixed contact 12.

Figure 3:
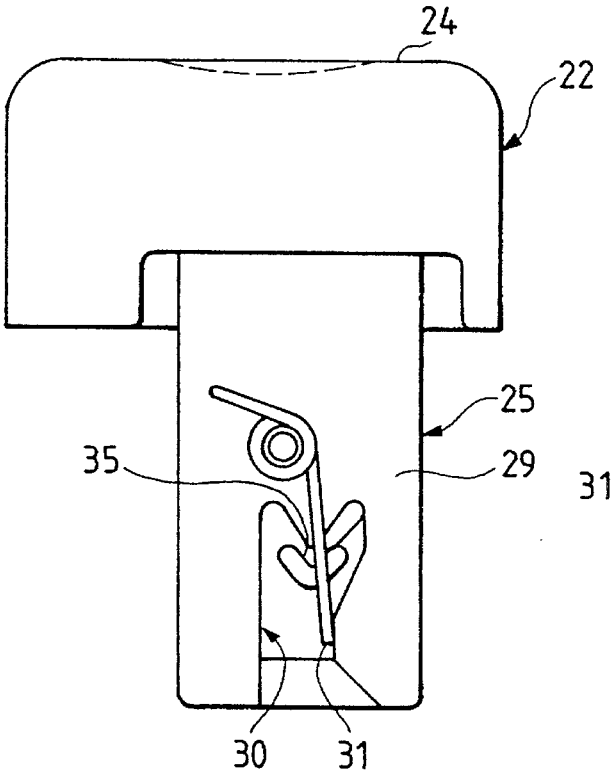
FIG. 3 is a side view showing the push button switch.

A coiled (auxiliary) spring 23 for breaking contact- is placed within the upper guide tube 15 in a state that the push button 22 is put on the top of the coiled spring 23. The push button 22, as shown in FIGS. 1 to 3, includes a head 24 where it is pushed by an external force applied thereto, a guide portion 25, and a guide conical part 26. As best illustrated in FIG. 4, the guide portion 25 is U-shaped in cross section so as to be inserted into a space, which is also U-shaped in cross section, defined by the lower and upper guide tubes 14 and 15, and the outer guide-tube 17. The guide conical part 26 is inserted into the top of the break-contact coiled spring 23.

Rectangular guide holes or stopper hole 28, axially elongated, are-formed in the portions of the walls of the legs 27 and 27 of the U-shaped guide portion 25, which correspond to the locations of the cutouts 14*a* and 14*a* of the lower guide tube 14. The protruded portions 18*c* and 18*c* of the sleeve 18 are put on the lower parts 28*a* of the guide holes 28. The push button 22 is constructed such that the lower parts 28*a* of the guide holes 28 stop the movement of the sleeve 18 toward the fixed contact 12. The guide holes 28 and the protruded portions 18*c* and 18*c* form a coupling mechanism for coupling the push button 22 with the sleeve 18.

The break-contact coiled spring 23 is arranged such that one end thereof is in contact with the foot of the conical part 16*a*, of the partition plate 16, while the other end is in contact with the foot of the guide conical part 26 of the push button 24. The coiled spring 23 thus arranged is compressed in a preset degree of compression. The break-contact coiled spring 23 urges upward the push button 22 by a force that is larger than that of the make-contact coiled spring 19. Since the force of the break-contact coiled spring 23 is thus larger than that of the make-contact coiled spring 19, the sleeve 18 is pulled up by the push button 22, to thereby be brought into contact with the partition plate 16. The inner diameter of the coiled spring 23 is larger than that of the coiled spring 19. These coiled springs are combined in an overlapping fashion, as shown in FIG. 4.

Figure 5:
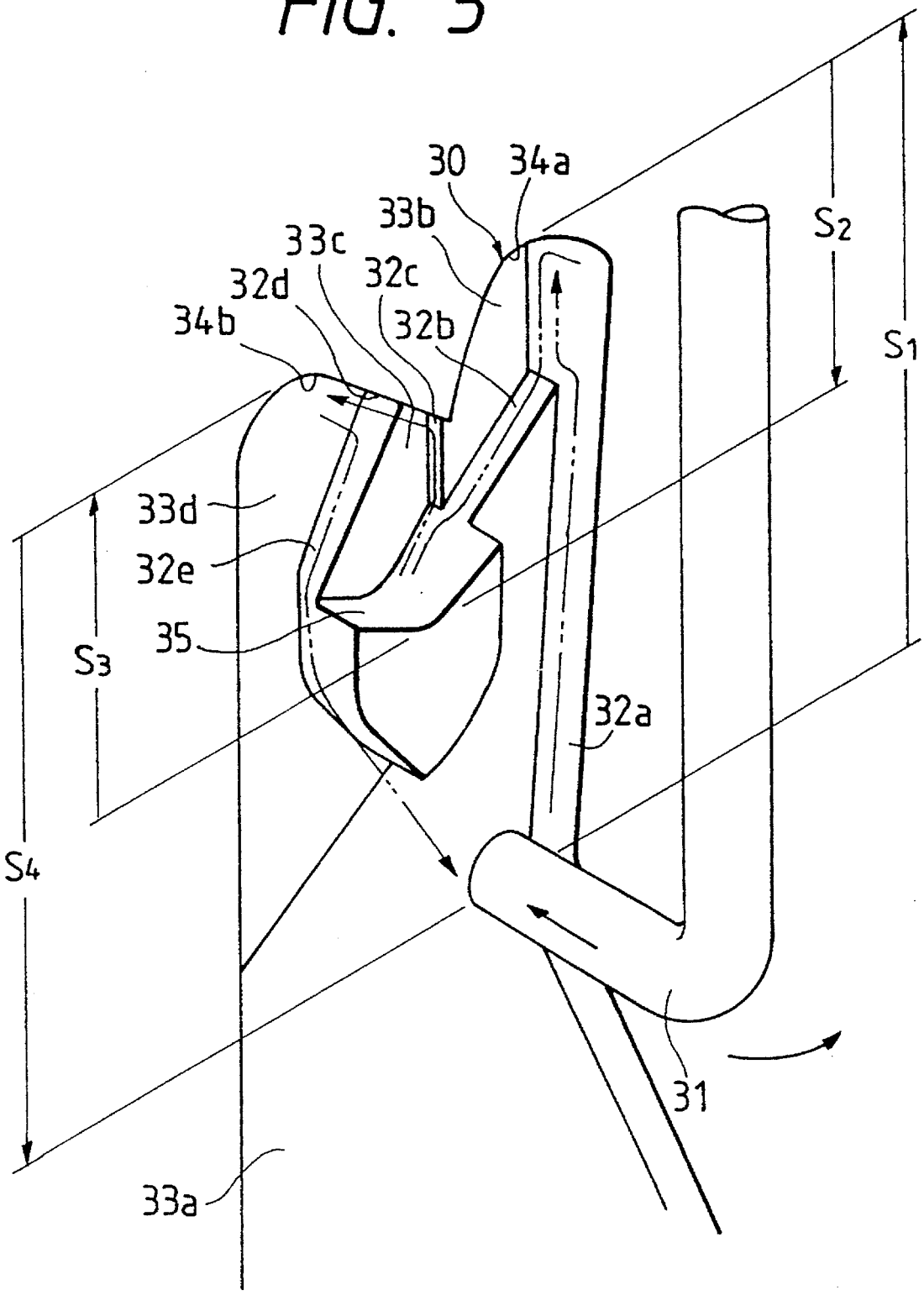
FIG. 5 is a perspective view showing a cam groove of a push button of the push button switch.
Figure 7:
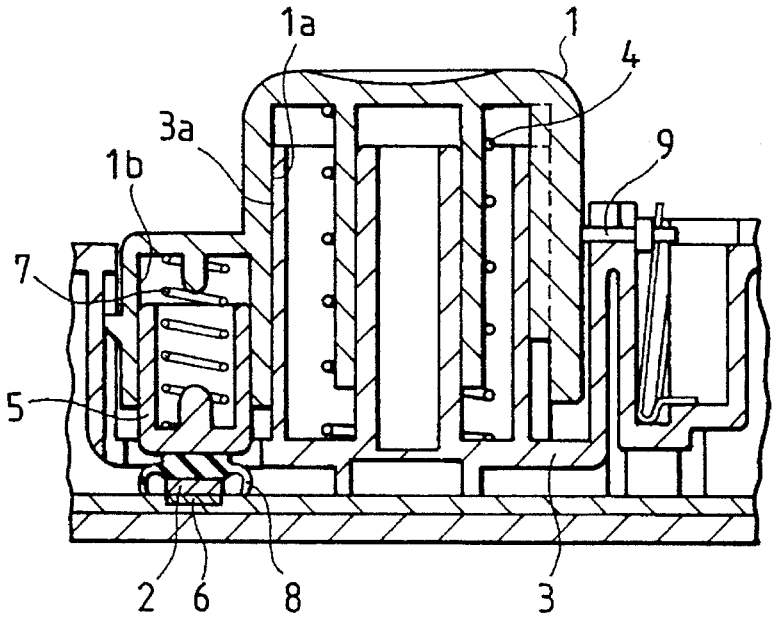
FIG. 7 PRIOR ART
FIG. 7 is a cross sectional view showing the push button switch of the FIG. 6, the illustration showing an on state of the switch.

As shown in FIGS. 3 to 5, a cam groove (cam) 30 is formed in the outer side of the bottom 29 of the U-shaped guide portion 25. A pin 31 of the housing 11 is brought into engagement with the cam 30. The pin 31 is formed by bending the end part of a twisted, coiled spring toward the bottom face of the cam groove 30. The end face of the pin 31 is urged toward the bottom of the cam groove 30, while at the same time the pin 31 is urged toward a first reference side face 32*a* of the cam groove 30. The construction of the cam groove 30 will be described in connection with the operation of the pin 31.

The cam groove 30 includes a first bottom face 33*a* (FIG. 5). When the push button 22 is at the highest position, the end face of the pin 31 comes in contact with the first bottom face 33*a*. At the highest position of the push button 22, the fixed contact and the movable contact are separated from each other, i.e., the push button switch is in an off state. In this state, if the push button 22 is pushed down, the pin 31 moves upward along the first reference side face 32*a*. When it moves a distance S1, the pin 31 abuts on an upper limit face 34*a*. The upper limit face 34*a*, located above the first reference side face 32*a*, is continuous to the first reference side face 32*a*. The width or depth of the upper limit face 34*a* is wider or deeper than the first reference side face 32*a*.

In this state where the end face of the pin 31 abuts on the upper limit face 34*a*, it is brought into contact with a second bottom face 33*b*, deeper than the first bottom face 33*a*. Then, an operator detaches his finger from the push button 22. In turn, the push button 22 moves upward by the force of the break-contact coiled spring 23. The pin 31 descends along the first reference side face 32*a* further obliquely descends downward along a second reference face 32*b*, and reaches an incurved part 35 continuous to the second reference face 32*b* end stops thereat. When the pin 31 reaches the incurved part 35, the pin 31 descends a distance S2. The second reference face 32*b* is a stepped part defined by the first bottom face 33*a* and the second bottom face 33*b*. At the incurred part 35, the end face of the pin 31 steps down to come in contact with a third bottom face 33*c*, deeper than the second bottom face 33*b*.

The pin 31 is stably held at the incurved part 35. The push button 22 is placed in a state that it is pushed down to a predetermined depth represented by S1–S2. At this time, the sleeve 18 is allowed to move downward a distance corresponding to the predetermined depth of the push button 22. Accordingly, the sleeve 18 is urged to move downward by the make-contact coiled spring 19, the rubber contact 21 is deflected, and the movable contact 20 comes in contact with the fixed contact 12. An on state of the push button switch is set up.

In this on state, the push button 22 is pushed down again. Then, the pin 31 moves upward. At this time, the pin 31 moves upward along a third reference face 32*c* as a stepped part defined by the second bottom face 33*b* and the third bottom face 33*c*. Further, it moves upward along a fourth reference face 32*d* obliquely and upwardly extended from the third reference face 32*c*. When it moves a distance S3, it comes in contact with a second upper limit face 34*b*, and stops there. At this time, the end face of the pin 31 is stepped down to reach a fourth bottom face 33*d*, deeper than the third bottom face 33*c*.

When an operator detaches his finger from the push button 22 at the position where the pin 31 is in contact with the second upper limit face 34*b*, the pin 31 moves downward along a fifth reference face 32*e* as a stepped part defined by the third bottom face 33*c* and the fourth bottom face 33*d*. When it moves downward a distance S3, the upper end face of the sleeve 18 comes in contact with the lower end face of the partition plate 16 and stops there. At this time, the end face of the pin 31 moves up from the fourth bottom face 33*d* to the first bottom face 33*a*. The fourth bottom face 33*d* becomes shallow from the second upper limit face 34*b* toward its lower part and is flush with the first bottom face 33*a*.

The portion including the incurved part 35 serves as a heart-shaped cam. The directions of the distances S1 to S4 indicate the direction of the movement of the pin 31 relative to the cam groove 30. These directions are opposite to the direction of the movement of the push button 22.

In the push button switch thus constructed, when the push button 22 is pushed in an off state of the switch, it moves the distance 81 and stops there. The operator detaches his finger from the push button 22. Then, the push button 22 moves back the distance 82 and stops there.

In this state, the sleeve 18 is movable up to such a position as to allow the movable contact 20 to come in contact with the fixed contact 12. The make-contact coiled spring 19 urges the sleeve 18 to move toward the fixed contact 12. Then, it deflects the rubber contact 21 to allow the movable contact 20 to come in contact with the fixed contact 12. Thus, the push button switch is placed to an on state.

In this state, the push button 22 is depressed again. The push button 22 moves the distance S3 and stops there. Then, the operator's finger is detached from the push button 22. The push button 22 moves back the distance S4 to reach the original position of the off state. At this time, the sleeve 18 is also moved up with the aid of the guide holes 28 and the protruded portions 18*c* and 18*c*. The movable contact 20 detaches from the fixed contact 12. The push button switch is placed to an off state.

In the push button switch thus constructed, the sleeve 18 with the movable contact 20 is movably placed in the lower guide tube 14 of the housing 11. The problem that the sleeve 18 moves in a greatly inclined state owing to the total fitting tolerance is successfully solved. Accordingly, the movable contact 20 is brought into contact with the fixed contact 12 in a state that these contacts are substantially parallel to each other. The frequency of occurrences of the poor contact trouble can remarkably be reduced.

The urging forces of the make-contact coiled'spring 19 and the break-contact coiled spring 23 act in the opposite directions. Because of this, a smaller force is required for operating the push button 22. Additionally, it is noted that the push button 22 and the sleeve 18 are coaxially disposed. With this structure, the force of the push button 22 does not make the push button 22 eccentric, and hence the sleeve 18 is smoothly movable in the axial direction.

Further, the inner diameter of the coiled spring 23 is larger than that of the coiled spring 19. These coiled springs are combined in an overlapping fashion. With this structure, the height of the push button switch may be reduced by a height corresponding to the length of the overlapping portion.

Furthermore, since the moving member is movably assembled into the housing, there is eliminated the sum of the two fitting tolerances, and hence a great inclination of the moving member when it moves. Accordingly, the movable contact 20 is brought into contact with the fixed contact 12 in a state that these contacts are substantially parallel to each other. The frequency of occurrences of the poor contact trouble can remarkably be reduced.

Additionally, the inner diameter of the break-contact coiled spring 23 is larger than that of the make-contact coiled spring 19. These coiled springs are combined in an overlapping fashion. With this structure, the height of the push button switch may be reduced by a height corresponding to the length of the overlapping portion.

What is claimed is:

1. A push button switch comprising:

a moving member movably disposed inside a housing;

a movable contact secured to the moving member;

a fixed contact disposed inside the housing;

a main spring for urging the moving member toward the fixed contact;

a push button disposed in an opening in the housing so as to be movable in the same direction as the moving member and so as to engage the moving member to prevent the moving member from moving when the push button switch is in an off state, wherein when the push button is pushed toward the fixed contact, the moving member is moved by the main spring by a preset distance toward the fixed contact so that the movable contact contacts the fixed contact and the push button switch is in an on state; and an auxiliary spring for urging the push button in a direction away from the fixed contact by a force that is larger than a force of the main spring, the auxiliary spring being disposed substantially coaxially with the main spring.

2. A push button as claimed in claim 1, further comprising;

a push button holding means for holding the push button in a predetermined position.

3. A push button as claimed in claim 2, wherein the push button holding means comprises:

a cam for setting up the on and off states of the switch; and a pin for engaging the cam, wherein when the push button is pushed toward the fixed contact with the pin being engaged with the cam, the push button is placed in the on state and the push button is held at a predetermined depth, and when the push button is further pushed with the pin being disengaged from the cam, the push button is placed in the off state and the push button is returned to an original position.

4. A push button as claimed in claim 1, wherein an inner diameter of the main spring is smaller than an inner diameter of the auxiliary spring, and the main and auxiliary springs partially overlap each other.

* * * * *